US005139352A

United States Patent [19]

Kawahara

[11] Patent Number: 5,139,352

[45] Date of Patent: Aug. 18, 1992

[54] RIBBON CARTRIDGE HAVING BIASING MEMBER FOR POSITIONING INK RIBBON TO PRINT POSITION

[75] Inventor: Morihisa Kawahara, Kawasaki, Japan

[73] Assignee: Fujitsu Limited, Kawasaki, Japan

[21] Appl. No.: 540,209

[22] Filed: Jun. 19, 1990

[30] Foreign Application Priority Data

Jun. 28, 1989 [JP] Japan ..... 1-165712

[51] Int. Cl.[5] ..... B41J 32/00

[52] U.S. Cl. ..... 400/208; 400/196

[58] Field of Search ..... 400/196, 196.1, 207, 400/208, 211, 242, 247

[56] References Cited

U.S. PATENT DOCUMENTS 4,408,914 10/1983 Ciesiel et al. ..... 400/247
4,798,486 1/1989 Kaneko ..... 400/208

FOREIGN PATENT DOCUMENTS 0250982 12/1985 Japan ..... 400/208
0287777 12/1986 Japan ..... 400/208
2170778 8/1986 United Kingdom ..... 400/208

OTHER PUBLICATIONS

IBM Tech. Disclosure Bulletin vol. 27 No. 4A Sep. 1984 Molded Tension Spring for Ribbon Cartridge.

*Primary Examiner*—Edgar S. Burr
*Assistant Examiner*—Ren Yan
*Attorney, Agent, or Firm*—Staas & Halsey

[57] ABSTRACT

A ribbon cartridge with an ink ribbon for use in a printer. The printer includes a print head and a carrier, the carrier carrying the print head and ribbon cartridge along a printing position. The carrier has a mounting member for rotatably mounting a first end of the ribbon cartridge and a guide member for positioning a second end of the ribbon cartridge such that the ink ribbon is disposed between the print head and printing position. The second end of the ribbon cartridge has an opening for exposing a part of the ink ribbon loaded in the body of the cartridge. The ribbon cartridge includes a biasing member for producing a force to bias the ribbon cartridge against the guide member by elastic deformation of the biasing member in contact with a part of the carrier. The biasing member is integrally formed as part of the ribbon cartridge, thus eliminating additional and separate components and reducing part and assembling costs. Limitation members are also integrally formed as part of the ribbon cartridge to restrict maximum pivotal movement of the second end of the ribbon cartridge when mounted to the carrier, thus ensuring that the biasing member of the cartridge is not deformed beyond its normal elasticity.

38 Claims, 4 Drawing Sheets

RIBBON CARTRIDGE HAVING BIASING MEMBER FOR POSITIONING INK RIBBON TO PRINT POSITION

BACKGROUND OF THE INVENTION

This invention relates to a ribbon cartridge having a biasing member for positioning an ink ribbon to print position for use in a printer. More particularly, this invention relates to an apparatus for uniformly restricting the running position of an ink ribbon to a print head of the printer.

In general, a carrier is provided within the printer and moveable in the printing direction. A print head is mounted on the carrier and a ribbon cartridge is removably, interchangeably and rotatably fitted thereto. Accordingly, under operating conditions, it is necessary to correctly position the ribbon cartridge so that the ink ribbon runs at the correct position opposed to the printer head.

FIG. 1 is a side view of a primary part of a conventional printer with a mounted ribbon cartridge.

The printer includes a carrier 1 and a platen 3. The carrier 1 is driven along the platen 3 normally using a wire and pulling arrangement such that the carrier 1 can reciprocably move parallel to and along the platen 3. The carrier 1 is moveable along a shaft 5. The above components and assembly of the printer are mounted and held in a frame (not shown). The shaft 5 is connected to and mounted between side walls (not shown) of the frame. A print head 7 is fixed to the carrier 1. The carrier 1 has upwardly extending pole members 9 located at both sides of the carrier 1. Each pole member 9 is formed with a through hole 11 at the top end thereof. A ribbon cartridge 13, loaded with an ink ribbon 15, has a support member 17 located at both sides of the ribbon cartridge 13. The cartridge 13 is axially and pivotally mounted by the support members 17 being positioned in through holes 11 formed in pole members 9. At the sides of the end opposite to the pivoting end of the cartridge 13 and in the rotating range of the cartridge, a pair of stoppers 19, 21 are provided for positioning the ink ribbon 15 to the print head 7. The ribbon cartridge 13 is biased in the direction of arrow mark "A" shown in FIG. 1 by a separate plate spring 23 fixed to the carrier 1, such as by a screw 15. The biasing force of spring 23 urges the ribbon cartridge 13 in such a direction as to engage with the stoppers 19, 21. This type of printer is further disclosed in Japanese Patent Publication (Koukoku) No. 53-12849 issued on May 4, 1978.

In a printer using this type of ribbon cartridge assembly, the separate plate spring 23 is provided to bias the ribbon cartridge 13 and a screw 25 has to be used for fixing such a plate spring 23 to the carrier. Therefore, considerable parts and assembling cost have been required just for providing bias for the ribbon cartridge 13.

SUMMARY OF THE INVENTION

Accordingly, it is a primary object of the present invention to provide a printer, ribbon cartridge positioning apparatus, and ribbon cartridge which have new and improved positioning of an ink ribbon of a ribbon cartridge to the print position.

Another object of the present invention is to provide a printer for biasing a ribbon cartridge to print position which has reduced parts and assembly costs thereof.

A further object of the present invention is to provide a ribbon cartridge having a biasing member for positioning an ink ribbon to print position.

Additional objects and advantages of the invention will be set forth in part in the description which follows, and, in part, will be obvious from the description, or may be learned by practice of the invention. The objects and advantages of the invention may be realized and obtained by means of the instrumentalities and combinations particularly pointed out in the appended claims.

To achieve the foregoing objects and in accordance with the purpose of the invention, as embodied and broadly described herein, there is provided a ribbon cartridge with an ink ribbon for use in a printer, the printer including a print head and a carrier for carrying the print head and the ribbon cartridge along a printing position, the carrier having mounting means for pivotally mounting a first end of the ribbon cartridge and guide means for positioning a second end of the ribbon cartridge such that the ink ribbon is disposed between the print head and printing position. The ribbon cartridge comprises: (a) a body member having an opening for exposing a part of the ink ribbon loaded into the body member; (b) engaging means formed on the body member for engaging the mounting means of the carrier; and (c) biasing means integrally formed on the body member for producing a force to bias the ribbon cartridge against the guide means of the carrier. As embodied herein, the body member comprises a case and a cover, with the biasing means being integrally formed on the cover. The case and cover are formed by a plastic molding technique.

In accordance with the invention, there is further provided improved printers and ribbon cartridge positioning apparatus using the above described ribbon cartridge.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
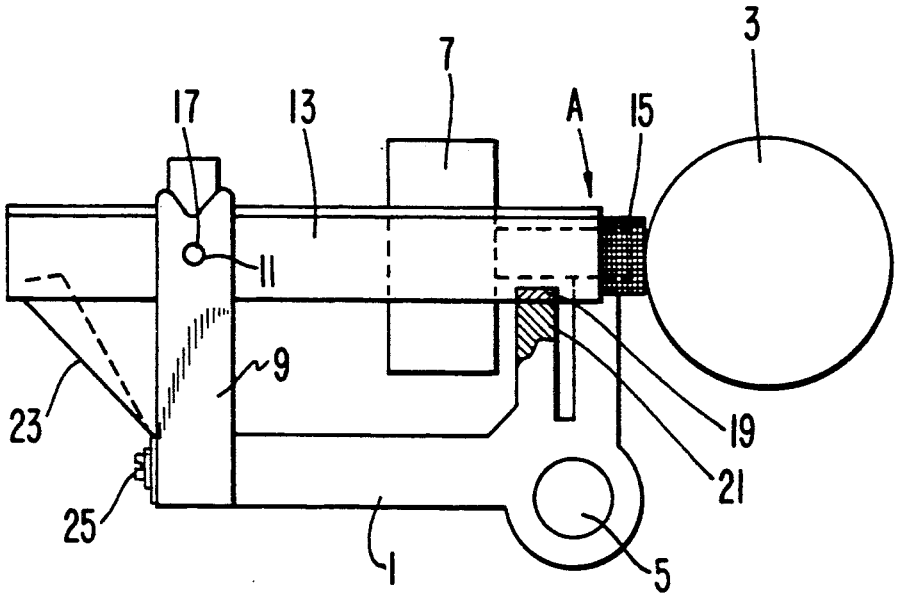
FIG. 1 (PRIOR ART)
FIG. 1 is a side view of a primary part of a conventional printer with a mounted ribbon cartridge.
Figure 2:
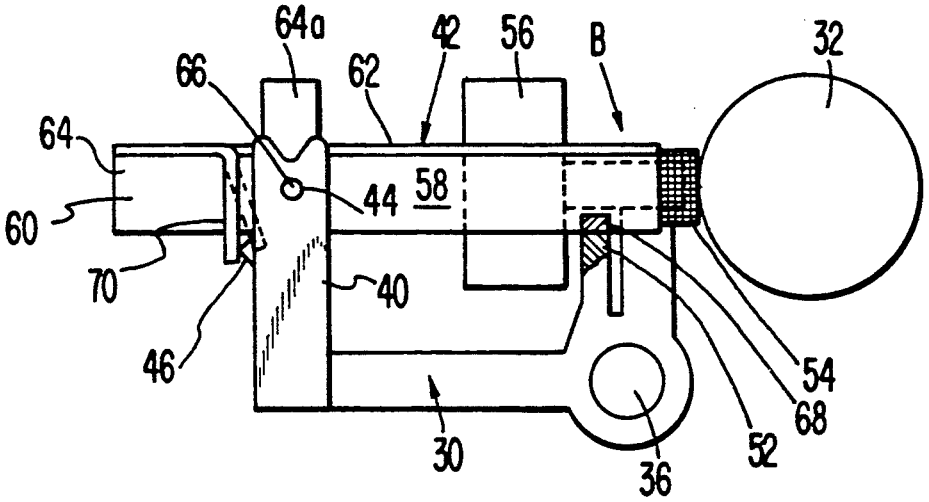
FIG. 2 is a side view illustrating the primary components of an embodiment of a printer with a mounted ribbon cartridge in accordance with the present invention.

FIG. 2 is a side view illustrating the primary components of an embodiment of a printer with a mounted ribbon cartridge in accordance with the present invention.

Figure 3:
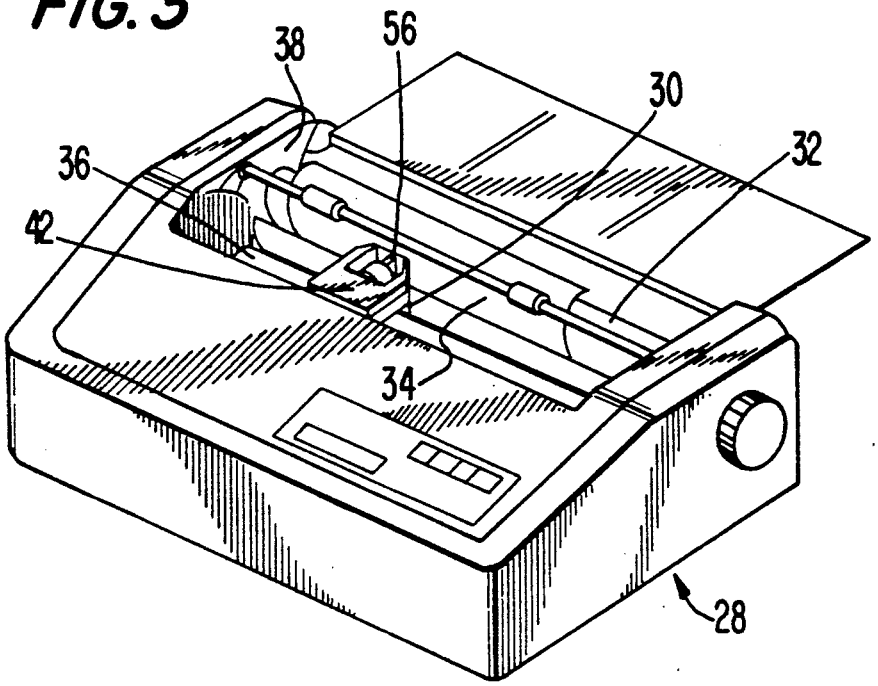
FIG. 3 is a perspective view illustrating an embodiment of a printer having a ribbon cartridge mounted therein in accordance with the present invention.

FIG. 3 is a perspective view of an embodiment of a printer illustrating a ribbon cartridge mounted therein in accordance with the present invention.

Figure 4:
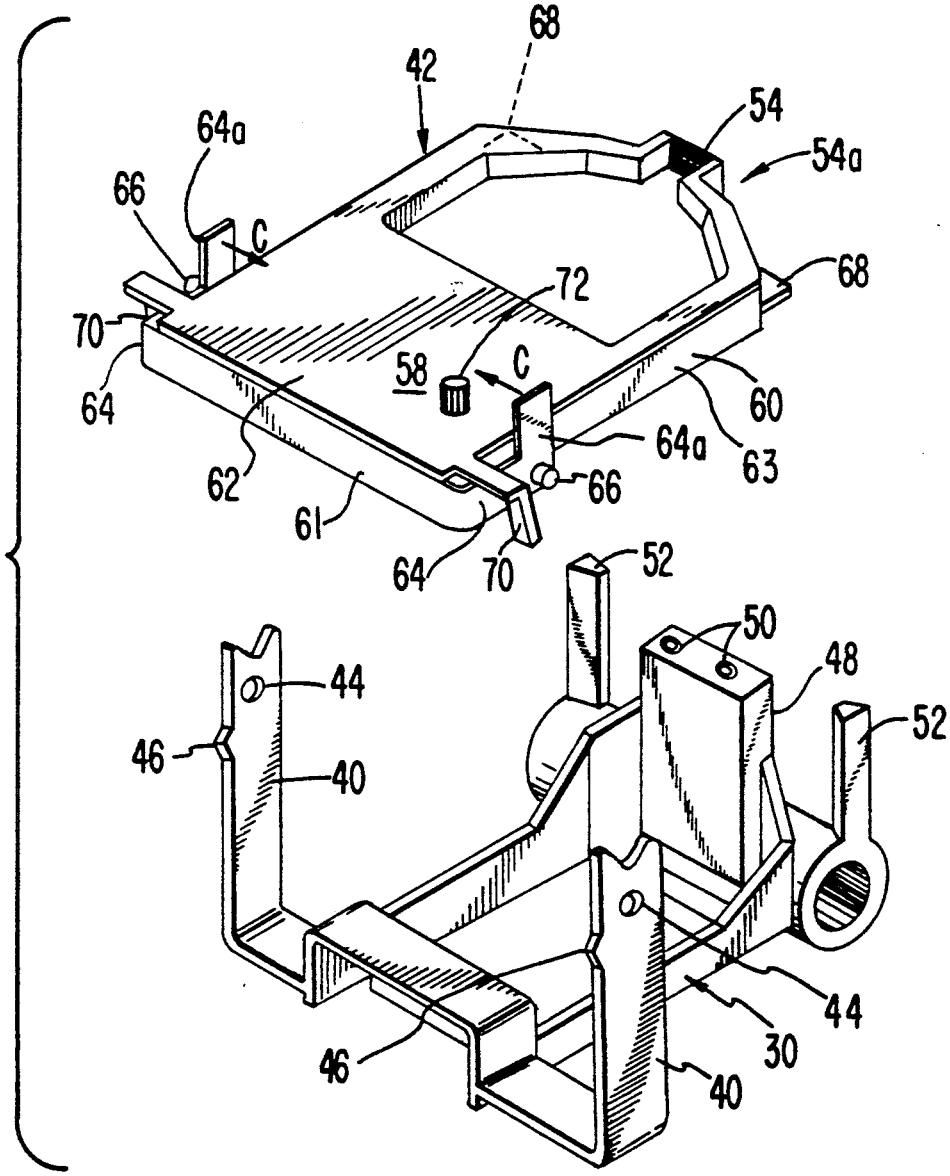
FIG. 4 is a perspective, exploded view illustrating primary components of the embodiment of a printer having a ribbon cartridge for mounting therein in accordance with the present invention.

FIG. 4 is a perspective, exploded view of the primary components of an embodiment of a printer showing dissembled a ribbon cartridge and carrier in accordance with the present invention.

As embodied herein and as shown in FIGS. 2-3, a printer 28 includes a carrier 30 and a platen 32. The platen 32 guides and positions a printable material, such as print paper 34 shown in FIG. 3. The carrier 30 is driven along the platen 32 by a conventional wire and pulling mechanism such that the carrier 30 can movably reciprocate parallel to and along the platen 32. The carrier 30 is located on and moves along shaft 36. The basic components for the printer are mounted and held in a frame 38 as shown in FIG. 3. The carrier shaft 36 is connected to and mounted between side walls of the frame 38 of the printer. The platen 32 is rotated by a motor (not shown) to move the printable paper 34 in a direction perpendicular to the direction of the movement of carrier 30.

As shown in FIGS. 2 and 4, the carrier 30 has two upwardly extending pole members 40 at the sides of the rear end of the carrier 30 opposite to the front end of the carrier located on shaft 36. An interval or gap is formed between the two pole members 40 which is larger than the width of a ribbon cartridge 42 to be mounted on the carrier as described below. At the top end of each pole member 40, a through hole 44 is formed for pivotally mounting the ribbon cartridge 42 to the carrier 30. Each pole member 40 also has a protrusion 46 extending outwardly from the rear end of member 40 as shown in FIG. 4. The carrier 30 also has a print head mounting member 48 located at the front end of the carrier 30. The print head mounting member 48 has screw thread holes 50 as shown in FIG. 4. Moreover, the carrier 30 has guide means, such as a pair of positioning or stopper members 52 located at the sides of the front end of the carrier 30 for positioning the front end of the ribbon cartridge 42. The ribbon cartridge 42 has an ink ribbon 54 such that ribbon 54 is disposed between a print head 56 and the platen 32 when the cartridge 42 is mounted carrier 30. As embodied herein, the pole members 40, the print head mounting member 48 and the positioning members 52, are integrally formed as part of the carrier 30, such as by aluminum die casting.

Reference numeral 56 in FIGS. 2 and 3 designates a print head, such as a matrix print head type, which is fixed to the carrier 30 at the mounting member 48 by threading screws (not shown) into holes 50.

Reference numeral 42 designates the ribbon cartridge loaded with an ink ribbon 54. As embodied herein, and as best shown in FIG. 4, the ribbon cartridge 42 comprises a body member 58 which is formed by fitting together a case 60 and a cover 62. The case 60 and cover 62 could, e.g., be press fit, sonically welded, or mechanically connected together. The case 60 of ribbon cartridge 42 is integrally formed with arms 64 that are located at opposite sides and extend from a rear end wall 61 of the case 60. More specifically, the arms 64 extend outwardly from the case 60 a predetermined length and are bent in a direction parallel to side walls 63 of the case 60. The arms 64 also have handle portions 64*a* extending upwardly. When the ribbon cartridge 42 is mounted to the carrier 30 or removed therefrom, the arms 64 are pushed toward the inside, as shown by arrow marks "C" shown in FIG. 4. Each arm 64 has an axis in the form of a protruding member 66 that is located at the lower end of handle portion 64*a* and that is pivotably or rotatably supported in the corresponding through hole 44 of pole member 40.

The ribbon cartridge 42 also includes a pair of guides 68 located and integrally formed at the opposite side of the front end of the case 60. The guides 68 are located so that, when the ribbon cartridge 42 is pivotally mounted on the carrier 30, the position of guides 68 corresponds to the top position of positioning members 52 of the carrier 30. Moreover, the ribbon cartridge 42 has an open portion at its front end 54*a* for exposing a part of the ink ribbon 54 loaded in the case 60 with the cover 62 provided on the case 60. As embodied herein, a pair of biasing members 70 extend outwardly from the opposite sides of the rear end of the cover 62 at a predetermined length. Members 70 are bent in a direction downwardly to the case 60 in the form of a letter "L" as best seen in FIG. 4. Members 70 are integrally formed as part of cover 62. Members 70 are located at the opposite sides of the rear end of the cover 62 such that, when the ribbon cartridge 42 is pivotally mounted on the carrier 30, the lower portions of the biasing members 70 contact the corresponding protrusions 46 of the pole members 40.

As embodied herein, the guides 68, arms 64, protruding members 66, handle portions 64*a* and other components of case 60 are integrally formed as one piece, such as by a plastic molding technique. The biasing members 70 and other components of case 60 are also integrally formed as one piece, such as by plastic molding techniques. Accordingly, the ribbon cartridge 42 can be formed by fitting only the two pieces, or case 60 and cover 62, together with ink ribbon contained therein. Reference numeral 72 designates an optional knob for manual winding of the ink ribbon 54.

As briefly explained above, when the ribbon cartridge 42 is mounted to the carrier 30, the ribbon cartridge 42 pushes the arms 64 toward the inside in an elastic deformation. Accordingly, the protruding members 66 are inserted or snapped into the holes 44 or drawn back therefrom. The ribbon cartridge 42 thus can be freely mounted to the carrier 30 or removed therefrom quickly and easily. Moreover, when the protruding members 66 engage the through holes 44 of pole members 40, the biasing members 70 of ribbon cartridge 42 contact the corresponding protrusions 46 of pole members 40 under normal conditions as indicated by a broken line in FIG. 2. With elastic deformation, the biasing members 70 of the cartridge are automatically urged into contact with the corresponding protrusions 46 of pole members 40 as indicated by a solid line in FIG. 2. As a result, the front end of the ribbon cartridge 42 toward the platen 32 is biased in the direction of arrow mark "B" as shown in FIG. 2, namely in such a direction that the guides 68 engage positioning members 52. As explained above, the ribbon cartridge 42 is biased so that the guides 68 and positioning members 52 are always engaged, maintaining the ink ribbon 54 in a correct position facing the print head 56.

Figure 5A:
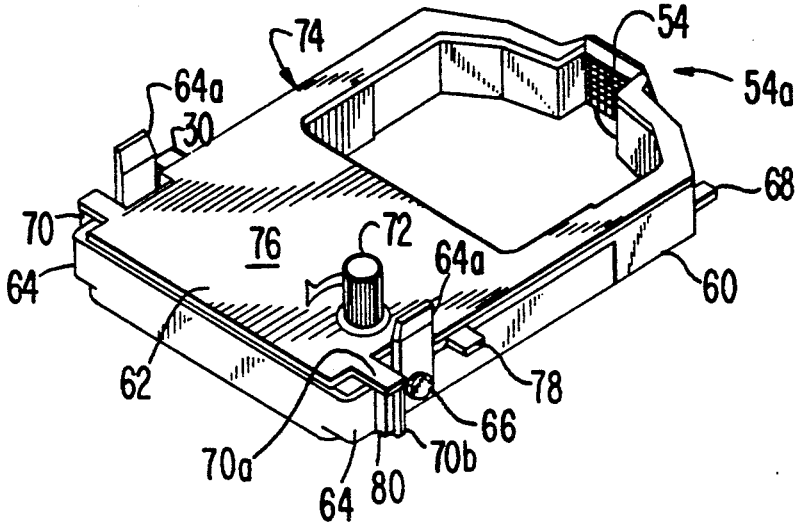
FIG. 5(A) is a perspective view illustrating another embodiment of a ribbon cartridge in accordance with the present invention.
Figure 5C:
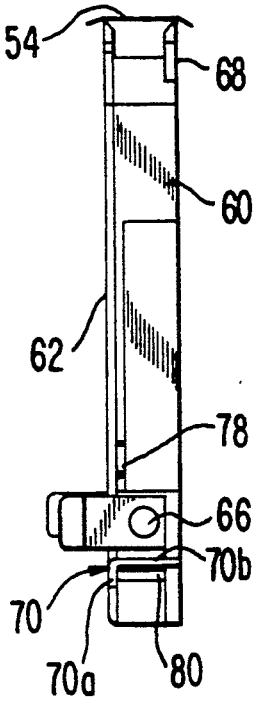
FIG. 5(C) is a side view illustrating the embodiment of FIG. 5(A) of a ribbon cartridge in accordance with the present invention.
Figure 5B:
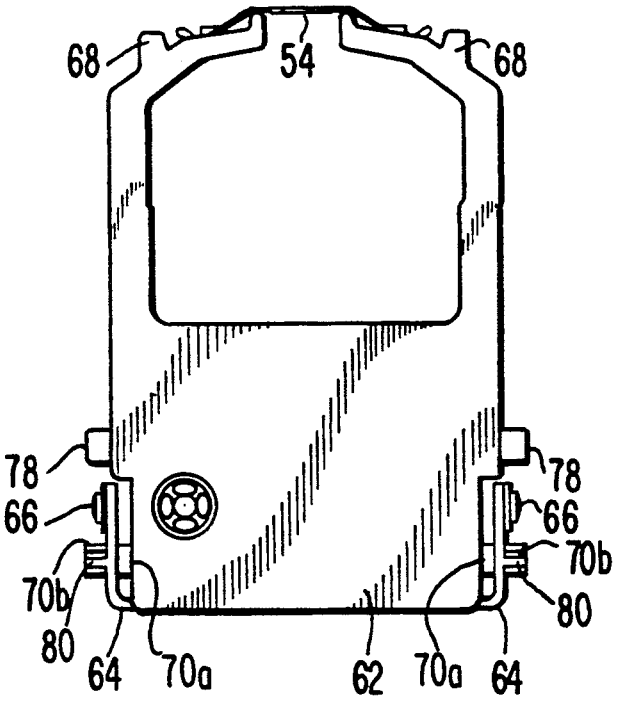
FIG. 5(B) is a bottom view illustrating the embodiment of FIG. 5(A) of a ribbon cartridge in accordance with the present invention.

FIG. 5(A) is a perspective view illustrating another embodiment of a ribbon cartridge in accordance with the present invention. FIG. 5(B) is a bottom view illustrating the embodiment of the ribbon cartridge of FIG. 5(A) in accordance with the present invention. FIG. 5(C) is a side view illustrating the embodiment of the ribbon cartridge of FIG. 5(A) in accordance with the present invention.

In the embodiment shown in FIGS. 5(A) through 5(C), a ribbon cartridge 74 has a body member 76 modified from the body member 58 for the first embodiment of the ribbon cartridge. Body member 76 includes two kinds of limitation members 78, 80 which, when the ribbon cartridge 42 is mounted to the carrier 30, limit the movement range of the front end of ribbon cartridge 74. If the front end of ribbon cartridge 42 is allowed to move beyond a maximum permissible point, the integral biasing members 70 of the cartridge can become broken or deformed beyond their normal elasticity. As embodied herein, a pair of limitation members 78 are formed on a modified case 60 in front of the corresponding protruding members 66. A pair of limitation members 80 are formed on the rear sides of the corresponding biasing members 70. More specifically, limitation member 80 extends downwardly from top portion 70*a* of the biasing member 70 and is spaced apart from the downwardly extending portion 70*b* of member 70 which is elastically deformed during operation. The limitation members 78 are integrally formed to case 60 and limitation members 80 are integrally formed to biasing members 70, which in turn are integrally formed as part of cover 62, such as by a plastic molding technique.

When the front end of the ribbon cartridge 42 is mounted to carrier 30 and starts to move up toward a predetermined maximum permissible limit, the limitation members 78 engage the front sides of the pole members 40 and the other limitation members 80 engage the back side of the downwardly extending portion 70*b* of biasing pieces 70 which are deformed, whereby the front end of the ribbon cartridge 42 is limited in its movement upwardly.

According to the present invention and as can be seen from the foregoing description of the preferred embodiments, a biasing means for positioning the ink ribbon to the print head is formed integrally to the ribbon cartridge, such as by a plastic molding technique. Accordingly, an additional separate part is not required for biasing the ribbon cartridge. Thus, part and assembling costs can be reduced in comparison with the conventional printer apparatus.

It is intended that the present invention cover the modifications and variations in the ribbon cartridge having a biasing member for positioning an ink ribbon to print position that fall within the spirit and scope of the appended claims and their equivalents, without limitation to the different environments in which to use such a ribbon cartridge, such as in different applications and types of printers.

What is claimed is:

1. A ribbon cartridge with an ink ribbon for use in a printer, the printer including a print head and a carrier for carrying the print head and the ribbon cartridge along a printing position, the carrier having a pair of mounting members for pivotably mounting at a first end and rear sides of the ribbon cartridge and guide means for positioning a second end of the ribbon cartridge such that the ink ribbon is disposed between the print head and printing position, the ribbon cartridge comprising:

(a) a body member having an opening for exposing a part of the ink ribbon loaded into the body member;

(b) a pair of engaging members, formed at rear sides of the body member, for engaging each of the engaging members to each of the mounting members of the carrier; and (c) a pair of biasing members, located at rear sides of and integrally formed on the body member, for producing a force to bias the ribbon cartridge against the guide means of the carrier, said biasing members being positioned so that each of said biasing members contacts one of said mounting members.

2. The ribbon cartridge as defined in claim 1, wherein the body member comprises a case and a cover.

3. The ribbon cartridge as defined in claim 2, wherein the pair of biasing members are integrally formed on the cover.

4. The ribbon cartridge as defined in claim 3, wherein the case and cover are each formed as a one-piece plastic molded member.

5. The ribbon cartridge as defined in claim 4, wherein the biasing members produce the force to bias the ribbon cartridge against the guide means from elastic deformation of the biasing members in contact with the corresponding pair of mounting members.

6. The ribbon cartridge as defined in claim 1, wherein the body member further comprises limitation means for limiting a moving range of the second end of the ribbon cartridge when the ribbon cartridge is mounted to the carrier.

7. The ribbon cartridge as defined in claim 6, wherein the limitation means is integrally formed on the body member.

8. The ribbon cartridge as defined in claim 6, wherein the limitation means comprises a first limitation member integrally formed at the side of the body member and a second limitation member integrally formed on each of the pair of biasing members of the ribbon cartridge.

9. A printer having a ribbon cartridge with an ink ribbon, the printer comprising:

(a) a platen;

(b) a print head;

(c) a ribbon cartridge;

(d) a carrier for carrying the print head and the ribbon cartridge and movement along the platen, the carrier having a pair of mounting members for rotatably mounting at a first end and rear sides of the ribbon cartridge and and guide means for positioning a second end of the ribbon cartridge such that the ink ribbon is disposed between the print head and the platen;

(e) a pair of engaging members, formed at rear sides of the ribbon cartridge, for engaging the mounting members of the carrier; and (f) a pair of biasing members, located at rear sides of and integrally formed on the ribbon cartridge, for producing a force to bias the ribbon cartridge against the guide means said biasing members being positioned so that each of said biasing members contacts one of said mounting members.

10. The printer as defined in claim 9, wherein each of the pair of mounting members includes a pole member being formed for pivotably mounting the opposite sides of the first end of the ribbon cartridge.

11. The printer as defined in claim 9, wherein the ribbon cartridge comprises a body member and a cover.

12. The printer as defined in claim 11, wherein the body member and cover are each formed as a one-piece plastic molded member.

13. The printer as defined in claim 11, wherein the pair of engaging members are integrally formed on the body member.

14. The printer as defined in claim 11, wherein the pair of biasing members are integrally formed on the cover.

15. The printer as defined in claim 12, wherein the biasing members produce the force to bias the ribbon cartridge against the guide means by elastic deformation of the biasing members in contact with the corresponding pair of mounting members.

16. The printer as defined in claim 9, wherein the ribbon cartridge further comprises limitation means for limiting a moving range of the second end of the ribbon cartridge when the ribbon cartridge is mounted to the carrier.

17. The printer as defined in claim 16, wherein the limitation means is integrally formed on the ribbon cartridge.

18. The printer as defined in claim 16, wherein the ribbon cartridge comprises a body member and cover and the limitation means comprises a first limitation member integrally formed on the body member and a second limitation member integrally formed on each of the pair of biasing members and wherein the pair of biasing members are integrally formed on the cover.

19. A ribbon cartridge positioning apparatus for use in a printer wherein a carrier carries a print head and a ribbon cartridge for movement along a print position, the apparatus comprising:

(a) a pair of mounting members, formed on the carrier, for rotatably mounting at a first end and rear sides of the ribbon cartridge;

(b) guide means, formed on the carrier, for positioning a second end of the ribbon cartridge such that the ink ribbon is disposed between the print head and the print position;

(c) a pair of engaging members, formed at rear sides of the ribbon cartridge, for engaging said biasing members being positioned so that each of said biasing members contacts one of said mounting members the mounting members of the carrier; and (d) a pair of biasing members, located at rear sides of and integrally formed on the ribbon cartridge, for producing a force to bias the ribbon cartridge against the guide means.

20. The ribbon cartridge positioning apparatus as defined in claim 19, wherein the ribbon cartridge comprises a case and a cover.

21. The ribbon cartridge positioning apparatus as defined in claim 20, wherein the pair of biasing members are integrally formed on the cover.

22. The ribbon cartridge positioning apparatus as defined in claim 20, wherein the case and cover of the ribbon cartridge are each formed as a one-piece plastic molded member.

23. The ribbon cartridge positioning apparatus as defined in claim 22, wherein the pair of biasing members produce the force to bias the ribbon cartridge against the guide means by elastic deformation of the biasing members in contact with the corresponding pair of mounting members of the carrier.

24. The ribbon cartridge positioning apparatus as defined in claim 19, wherein the ribbon cartridge comprises limitation means for limiting a moving range of the second end of the ribbon cartridge when the ribbon cartridge is mounted to the carrier.

25. The ribbon cartridge positioning apparatus as defined in claim 24, wherein the limitation means is integrally formed on the ribbon cartridge.

26. The ribbon cartridge positioning apparatus as defined in claim 24, wherein the ribbon cartridge comprises a body member and cover and the limitation means comprises a first limitation member integrally formed on the body member and a second limitation member integrally formed on each of the pair of biasing members and wherein the pair of biasing members are integrally formed to the cover.

27. A printer having a ribbon cartridge with an ink ribbon, the printer comprising:

(a) means for guiding and locating a printable material to a printing position;

(b) a print head for printing to the printable material using an ink ribbon being disposed between the print head and printable material located by the material guiding and locating means;

(c) a pair of mounting members having a corresponding pair of pole members for pivotably mounting the first end of the ink ribbon cartridge therebetween such that the cartridge moves at a direction perpendicular to a direction of the printing lines;

(d) guide means for positioning, at a direction perpendicular to a direction of the printing lines, the second end of the ribbon cartridge such that the ink ribbon is disposed between the print head and printing position of the material;

(e) a pair of engaging members having a corresponding pair of members at the opposite sides of the first end of ribbon cartridge for detachably and pivotally engaging the corresponding pair of pole members of the mounting means; and (f) a pair of biasing members, located at the rear sides of and integrally formed on the ribbon cartridge, for producing a force to bias the ribbon cartridge against the guide means said biasing members being positioned so that each of said biasing members contacts one of said mounting members.

28. The printer as defined in claim 27, wherein the ribbon cartridge comprises a case and a cover each formed as a one-piece plastic molded member.

29. The printer as defined in claim 28, wherein the pair of biasing members are integrally formed on the cover.

30. The printer as defined in claim 28, wherein the biasing members produce the force to bias the ribbon cartridge against the guide means by elastic deformation of the biasing members in contact with the corresponding pair of mounting members.

31. The printer as defined in claim 27, wherein each pole member of the corresponding mounting member has a projection to act as a contact position for the corresponding biasing member.

32. The printer as defined in claim 27, wherein the ribbon cartridge further comprises limitation means for limiting a moving range of the second end of the ribbon cartridge when the ribbon cartridge is pivotally mounted to the mounting means.

33. The printer as defined in claim 32, wherein the limitation means is integrally formed on the ribbon cartridge.

34. The printer as defined in claim 32, wherein the ribbon cartridge comprises a base and a cover and the limitation means comprises a first limitation member integrally formed on the base and a second limitation member integrally formed on each of the pair of biasing members.

35. A ribbon cartridge with an ink ribbon for use in a printer, the printer including a print head and a carrier for carrying the print head and the ribbon cartridge along a printing position, the carrier having mounting means for pivotably mounting a first end of the ribbon cartridge and guide means for positioning a second end of the ribbon cartridge such that the ink ribbon is disposed between the print head and printing position, the ribbon cartridge comprising:

(a) a body member having an opening for exposing a part of the ink ribbon loaded into the body member;

(b) engaging means, formed on the body member, for engaging the mounting means of the carrier;

(c) biasing means, integrally formed on the body member, for producing a force to bias the ribbon cartridge against the guide means of the carrier; and (d) limitation means for limiting a moving range of the second end of the ribbon cartridge when the ribbon cartridge is mounted to the carrier, the limitation means including a first limitation member integrally formed at the side of the body member and a second limitation member integrally formed on the biasing means of the ribbon cartridge.

36. A printer having a ribbon cartridge with an ink ribbon, the printer comprising:

(a) a platen;

(b) a print head;

(c) a ribbon cartridge including a body member and a cover;

(d) a carrier for carrying the print head and the ribbon cartridge and movement along the platen, the carrier having mounting means for rotatably mounting a first end of the ribbon cartridge and guide means for positioning a second end of the ribbon cartridge such that the ink ribbon is disposed between the print head and the platen;

(e) engaging means, formed on the ribbon cartridge, for engaging the mounting means of the carrier;

(f) biasing means, integrally formed on the ribbon cartridge, for producing a force to bias the ribbon cartridge against the guide means; and (g) limitation means for limiting a moving range of the second end of the ribbon cartridge when the ribbon cartridge is mounted to the carrier, the limitation means including a first limitation member integrally formed on the body member and a second limitation member integrally formed on the biasing means.

37. A ribbon cartridge positioning apparatus for use in a printer wherein a carrier carries a print head and a ribbon cartridge having a body member and a cover for movement along a print position, the apparatus comprising:

(a) mounting means, formed on the carrier, for rotatably mounting a first end of the ribbon cartridge;

(b) guide means, formed on the carrier, for positioning a second end of the ribbon cartridge such that the ink ribbon is disposed between the print head and the print position;

(c) engaging means, formed on the ribbon cartridge, for engaging the mounting means of the carrier;

(d) biasing means, integrally formed on the cover of the ribbon cartridge, for producing a force to bias the ribbon cartridge against the guide means; and (e) limitation means for limiting a moving range of the second end of the ribbon cartridge when the ribbon cartridge is mounted to the carrier, the limitation means including first limitation member integrally formed on the body member and a second limitation member integrally formed on the biasing means.

38. A printer having a ribbon cartridge with a base, a cover and an ink ribbon, the printer comprising:

(a) means for guiding and locating a printable material to a printing position;

(b) a print head for printing to the printable material using an ink ribbon being disposed between the print head and printable material located by the material guiding and locating means;

(c) mounting means having a pair of pole members for pivotably mounting the first end of the ink ribbon cartridge therebetween such that the cartridge moves at a direction perpendicular to a direction of the printing lines;

(d) guide means for positioning, at a direction perpendicular to a direction of the printing lines, the second end of the ribbon cartridge such that the ink ribbon is disposed between the print head and printing position of the material;

(e) engaging means having a pair of members at the opposite sides of the first end of ribbon cartridge for detachably and pivotally engaging the pole members of the mounting means;

(f) biasing means, integrally formed on the ribbon cartridge, for producing a force to bias the ribbon cartridge against the guide means.; and (g) limitation means for limiting a moving range of the second end of the ribbon cartridge when the ribbon cartridge is pivotally mounted to the mounting means, the limitation means including a first limitation member integrally formed on the base and a second limitation member integrally formed on the biasing means.

* * * * *

UNITED STATES PATENT AND TRADEMARK OFFICE

CERTIFICATE OF CORRECTION

PATENT NO. : 5,139,352

DATED : August 18, 1992

INVENTOR(S) : MORIHISA KAWAHARA

It is certified that error appears in the above-identified patent and that said Letters Patent is hereby corrected as shown below:

| | | |
|---|---|---|
| Col. 6, | line 8 (claim 1), | delete "each of the en-"; |
| | line 9 (claim 1), | delete "gaging members to each of"; |
| | line 54 (claim 9), | delete "and" second occurrence; |
| | line 64 (claim 9), | "means said" s/b --means of the carrier, said--. |
| Col. 7, | line 47 (claim 19), | delete "said biasing"; |
| | line 48-49 (claim 19), | delete lines 48-49 in their entirety; |
| | line 50 (claim 19), | delete "bers"; |
| | line 54 (claim 19), | "means." s/b --means, said biasing members being positioned so that each of said biasing members contacts one of said mounting members.--; |
| Col. 8, | line 46 (claim 27), | "means" s/b --means,--. |

Signed and Sealed this

Twenty-sixth Day of October, 1993

*Attest:*

*Attesting Officer*

BRUCE LEHMAN

*Commissioner of Patents and Trademarks*